US010129654B2

(12) United States Patent
Ge et al.

(10) Patent No.: US 10,129,654 B2
(45) Date of Patent: Nov. 13, 2018

(54) MINIATURE LOUDSPEAKER

(71) Applicant: GOERTEK INC., WeiFang, Shandong (CN)

(72) Inventors: Lianshan Ge, Weifang (CN); Wenqiang Dong, WeiFang (CN); Tianli Guo, WeiFang (CN)

(73) Assignee: GOERTEK INC., Weifang, Shandong (CN)

( * ) Notice: Subject to any disclaimer, the term of this patent is extended or adjusted under 35 U.S.C. 154(b) by 0 days.

(21) Appl. No.: 15/532,190

(22) PCT Filed: Nov. 11, 2015

(86) PCT No.: PCT/CN2015/094260
§ 371 (c)(1),
(2) Date: Jun. 1, 2017

(87) PCT Pub. No.: WO2016/086757
PCT Pub. Date: Jun. 9, 2016

(65) Prior Publication Data

US 2017/0339492 A1 Nov. 23, 2017

(30) Foreign Application Priority Data

Dec. 2, 2014 (CN) ..... 2014 1 0723379

(51) Int. Cl.
*H04R 1/20* (2006.01)
*H04R 9/06* (2006.01)
(Continued)

(52) U.S. Cl.
CPC ..... *H04R 9/06* (2013.01); *H04R 1/288* (2013.01); *H04R 7/18* (2013.01); *H04R 9/025* (2013.01);
(Continued)

(58) Field of Classification Search
CPC . H04R 9/06; H04R 1/288; H04R 7/18; H04R 9/025
(Continued)

(56) References Cited

U.S. PATENT DOCUMENTS 9,025,808 B2 * 5/2015 Kwon ..... H04R 9/043 381/398
2013/0148834 A1 * 6/2013 Seo ..... H04R 1/2811 381/338
(Continued)

FOREIGN PATENT DOCUMENTS

CN 201854412 U 6/2011
CN 102396210 A 3/2012
(Continued)

*Primary Examiner* — Sean H Nguyen
(74) *Attorney, Agent, or Firm* — Holzer Patel Drennan

(57) ABSTRACT

Disclosed is a micro loudspeaker, which comprises a magnetic circuit system, a vibration system and a support system. The magnetic circuit system comprises a yoke, and a magnet and a washer accommodated within the yoke. The vibration system comprises a diaphragm and a voice coil adhesively fixed to the diaphragm. The support system comprises a front cover, and a housing matched and combined with the front cover. The housing comprises a bottom wall and a side wall. The bottom wall is provided with a mounting portion accommodating the magnetic circuit system, and is also provided with an assembly plane for assembly with a terminal. A height difference is provided between a position of the bottom wall of the housing corresponding to the assembly plane and a position of the side wall of the housing corresponding to the assembly plane, so as to cooperatively form an avoidance inclined surface.

4 Claims, 6 Drawing Sheets

(51) Int. Cl.

| | |
|---|---|
| ***H04R 1/28*** | (2006.01) |
| ***H04R 7/18*** | (2006.01) |
| ***H04R 9/02*** | (2006.01) |
| *H04R 1/34* | (2006.01) |

(52) U.S. Cl.
CPC ..... *H04R 1/345* (2013.01); *H04R 2400/03* (2013.01); *H04R 2400/11* (2013.01); *H04R 2499/11* (2013.01); *H04R 2499/15* (2013.01)

(58) Field of Classification Search
USPC ..... 381/354
See application file for complete search history.

(56) References Cited

U.S. PATENT DOCUMENTS

| | | | | |
|---|---|---|---|---|
| 2013/0156237 | A1* | 6/2013 | Kim | H04R 9/06 381/191 |
| 2016/0127834 | A1* | 5/2016 | Kim | H04R 9/06 381/394 |

FOREIGN PATENT DOCUMENTS

| | | | |
|---|---|---|---|
| CN | 103299654 | A | 9/2013 |
| CN | 104469634 | A | 3/2015 |
| CN | 204291368 | U | 4/2015 |

* cited by examiner

MINIATURE LOUDSPEAKER

TECHNICAL FIELD

The present invention relates to the electro-acoustic field, and more particularly to a micro loudspeaker.

BACKGROUND

With the rapid development of the information industry and the electronics industry, a micro loudspeaker, as an electro-acoustic conversion device, has been widely applied to terminal equipment, such as computers, mobile phones and the like. Referring to FIG. 6, the schematic view for simulating terminal system assembly of with the existing micro loudspeaker is shown. In the structure of the conventional micro loudspeaker, a sound hole 9' is often located at the bottom of a housing to emit sound vertically, a damper 10' covers the surface of the sound hole 9', and the positions of the bottom wall and the side walls of the housing corresponding to the assembly plane of the product are at the same height, i.e., in a same horizontal plane. During machine assembly, the bottom plane of the micro loudspeaker product is flush with the assembly plane of the terminal machine, and thus the sound hole 9' in the prior art is easily blocked, thereby affecting the installation test curve.

SUMMARY

In view of the above-mentioned problems, the technical problem to be solved by the present invention is to provide a micro loudspeaker, and the sound hole structure in the existing micro loudspeakers is changed when the components remain unchanged, and when the micro loudspeaker product is assembled with the terminal equipment, it may ensure that the sound hole can let out the air from the lateral side.

In order to solve the above problems, the technical solution of the present invention is described below A micro loudspeaker comprises a magnetic circuit system, a vibration system and a support system, and the magnetic circuit system comprises a yoke, and a magnet and a washer accommodated in the yoke, the vibration system comprises a diaphragm and a voice coil bonded and fixed to the diaphragm; the support system comprises a front cover and a housing matched with and combined with the front cover, wherein the housing comprises a bottom wall and a side wall, the bottom wall of the housing is provided with a mounting portion for accommodating the magnetic circuit system and is provided with an assembly plane for assembling with a terminal, a height difference is provided between a position of the bottom wall of the housing corresponding to the assembly plane and a position of the side wall of the housing corresponding to the assembly plane, so as to cooperatively form an avoidance inclined surface, and sound holes are provided on the bottom wall of the housing, and opening ends of the sound holes are located on the avoidance inclined surface.

Wherein the side wall of the housing has a rectangular structure formed by four upright sides. The position of the side wall of the housing corresponding to the bottom surface of the micro loudspeaker is lower than a height of the position of the bottom wall of the housing corresponding to the bottom surface of the micro loudspeaker, so as to form an avoidance inclined surface, and form a sound hole of which a bottom surface is an inclined surface correspondingly.

Wherein the yoke has a rectangular structure. The yoke comprises a base in a horizontal direction and a side portion protruding in a vertical direction. The yoke is fixed to the mounting portion of the bottom wall of the housing, and the base of the yoke is the assembly plane for assembling with the terminal.

Wherein the sound hole is covered with a damper. The damper has a rectangular structure and is matched with and fixed to the avoidance inclined surface of the housing, and the damp is adhered to a surface of the sound hole obliquely.

Wherein a reinforcing member is bonded to the intermediate position of the diaphragm, and an inner edge of the diaphragm surrounds an outer periphery of the reinforcing member.

According to the technical solution of the present invention, the advantageous effect of the present invention is described below.

As the bottom wall of the housing of the micro loudspeaker according to the present invention is provided with an assembly plane for assembling with the terminal, and a height difference is provided between a position of the bottom wall of the housing corresponding to the assembly plane and a position of the side wall of the housing corresponding to the assembly plane, and thus the bottom wall and the side wall of the housing are no longer in a same horizontal plane but cooperate with each other so as to form a downward inclined surface at the bottom of the product. When the micro loudspeaker is assembled with terminals, such as mobile phones, computers and the like, the bottom of the product is not flush with the assembly plane, and the sound hole is located on the bottom wall of the housing, and its opening end is just located on the inclined surface. Thus, although the sound hole is located on the bottom of the product, there is a gap left between the sound hole and the assembly plane, the sound hole can let out air from the lateral side, and the installation test curve will not be affected due to the sound hole being blocked.

As the position of the side wall of the housing corresponding to the bottom surface of the product is lower than the corresponding position of the bottom wall of the housing, an avoidance inclined surface which is inclined downward will be formed in the assembly plane for the housing and the terminal, and correspondingly, a sound hole of which the bottom surface is an inclined surface will be formed between the housing and the yoke, and the vertical sound production pattern is changed into a downward inclined sound production pattern, and the sound hole is prevented from being blocked when the product is assembled with the terminal.

As the sound hole is covered with a damper, and the damper is matched with the avoidance inclined surface of the housing and inclined to fit the surface of the sound hole, the damper adhered obliquely is matched with the avoidance inclined surface of the housing to ensure that the sound hole may let out the air from the lateral side when the product is assembled with the terminal.

In summary, the micro loudspeaker of the present invention can solve the technical problem in the prior art that the sound hole is easily to be blocked since the bottom plane is flush with the assembly plane of the product. In the micro loudspeaker of the present invention, the avoidance inclined surface is formed between the bottom wall and the side walls of the housing, and the opening end of the sound hole is located on the above avoidance inclined surface. When the product is assembled with the terminal, as the sound hole is not flush with the assembly plane, the sound hole can let out the air from the lateral side, and thus the installation test curve will not be affected

Figure 1:
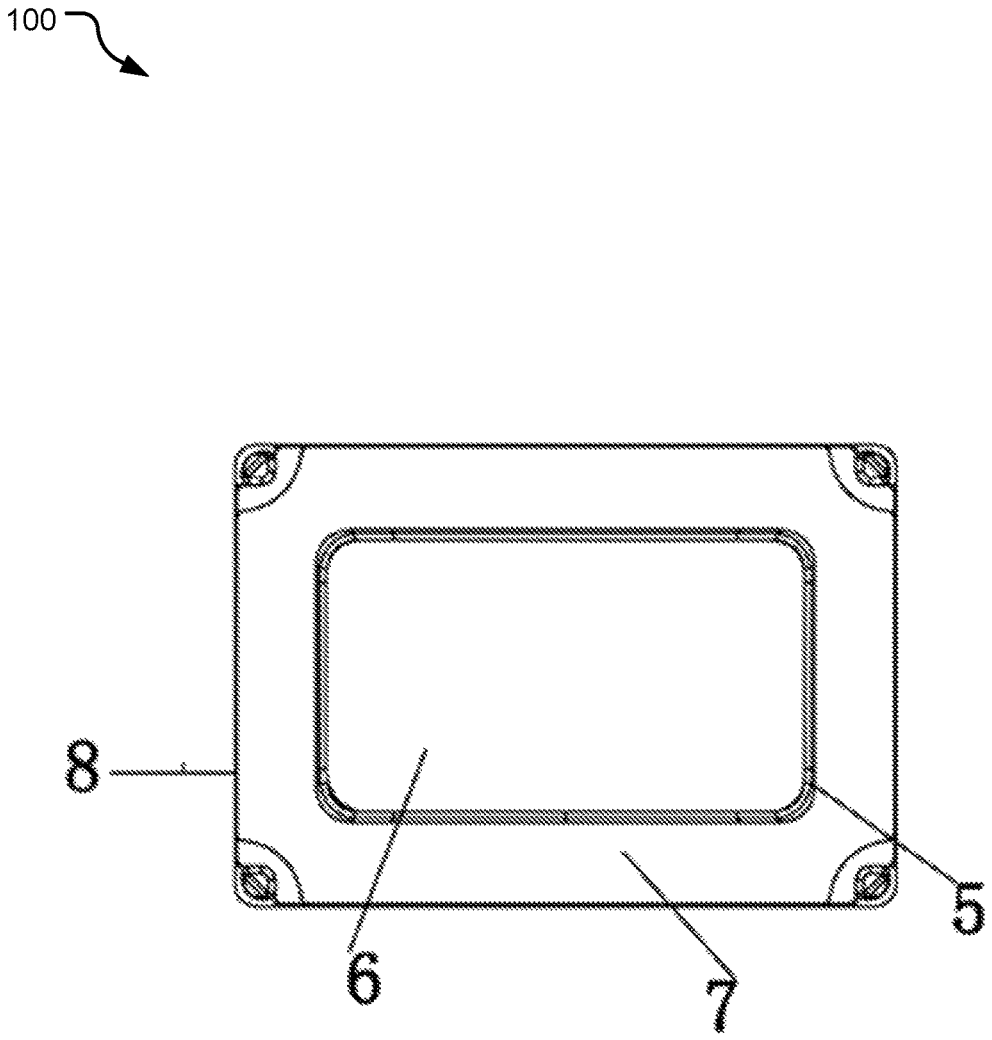
FIG. 1 is a top view of a micro loudspeaker according to the present invention.
Figure 2:
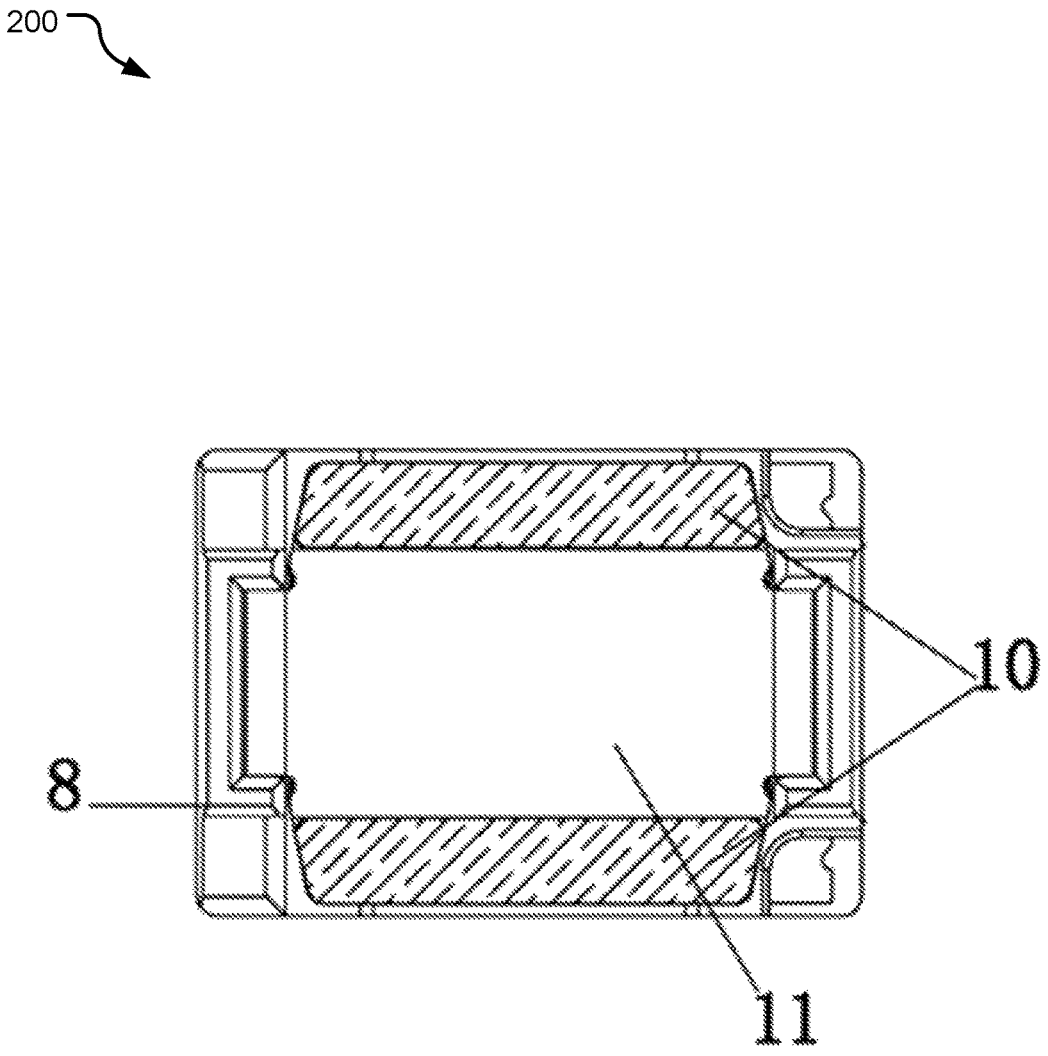
FIG. 2 is a bottom view of a micro loudspeaker according to the present invention.

The reference numerals comprise: 1, yoke; 2, magnet; 3, washer; 4, voice coil; 5, diaphragm; 6, reinforcing member; 7, front cover; 8, housing; 9, sound hole; 9', sound hole; 10, damper; 10', damper; 11, magnetic circuit system; 12, terminal machine assembly plate.

DETAILED DESCRIPTION

The present invention will be described below in details with reference to the accompanying drawings and embodiments.

Figure 4:
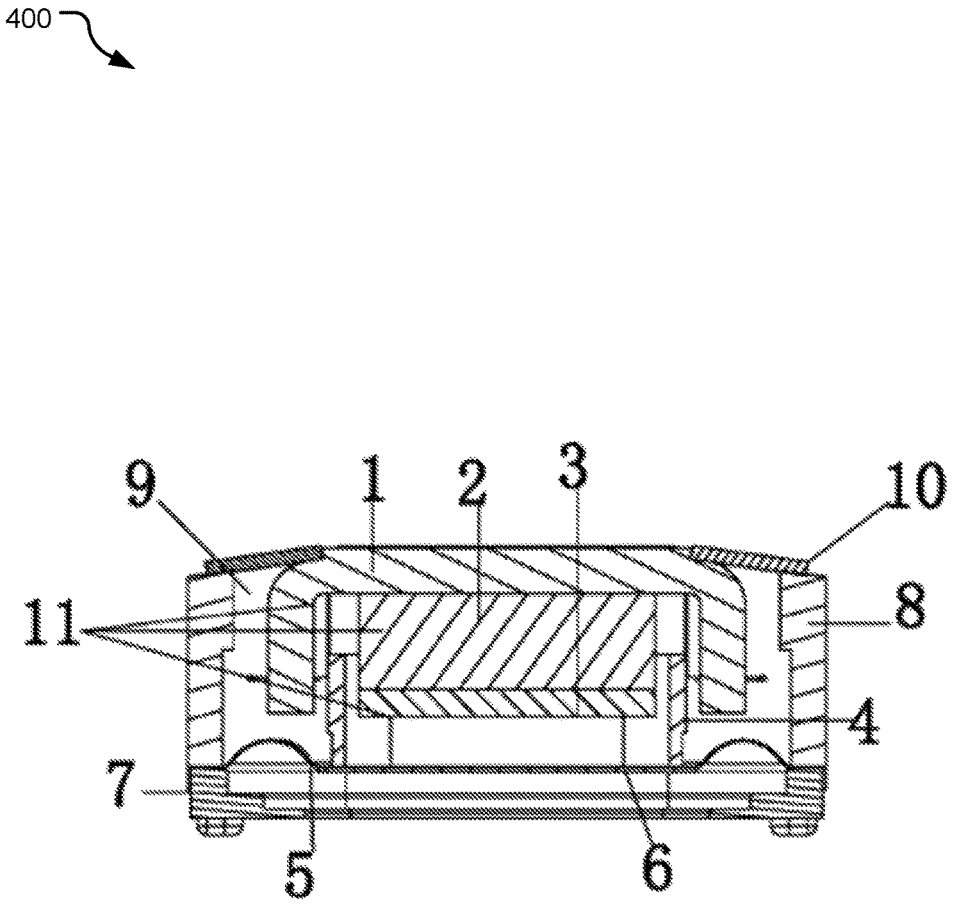
FIG. 4 is a cross-sectional view of the micro loudspeaker according to the present invention taken along the minor axis of the housing.

As shown in FIG. 4, a micro loudspeaker comprises a magnetic circuit system 11, a vibration system and a support system. The magnetic circuit system 11 comprises a yoke 1, and a magnet 2 and a washer 3 accommodated in the yoke 1, the magnet 2 and the washer 3 are bonded and fixed to an intermediate position at an inner side of the base of the yoke sequentially, and a magnetic gap is formed between the side portion of the magnet 2 and the washer 3 and the side portion of the yoke 1. The vibrating system comprises a diaphragm 5 and a voice coil 4 bonded and fixed to the diaphragm, and the end part of the voice coil 4 close to the magnetic circuit system 11 is located in the magnetic gap. When the coil of the voice coil 4 receives electrical signals having different magnitude and direction, the voice coil 4 will move in the magnetic gap and cut the magnetic induction lines back and forth, and the diaphragm 5 will vibrate in response, thus driving air so as to emit sound, and the electrical signal is converted into sound signal to be output, and then the conversion between electric energy and acoustic energy is completed.

Figure 5:
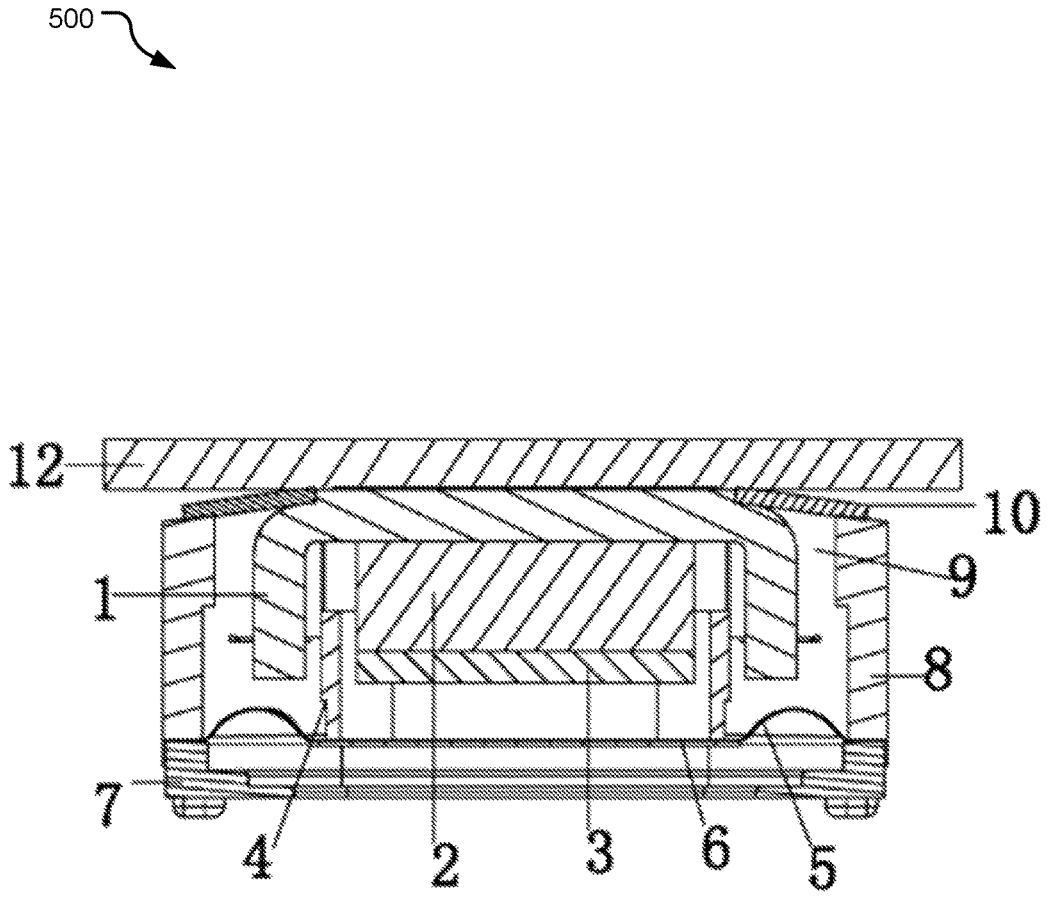
FIG. 5 is a schematic view for simulating machine assembly with the micro loudspeaker according to the present invention.

As shown in FIG. 4, the support system of the micro loudspeaker comprises a front cover 7 and a housing 8 matching with and combined with the front cover. The housing 8 comprises a bottom wall and a side wall, and the bottom wall of the housing 8 is provided with a mounting portion in which the magnetic circuit system 11 is accommodated. The bottom wall of the housing 8 is also provided with an assembly plane for assembling with a terminal device such as a mobile phone or a computer. The side wall of the housing 8 has a rectangular structure formed by four upright sides, and the position of the side wall corresponding to the bottom surface of the micro loudspeaker is lower than the position of the bottom wall of the housing 8 corresponding thereto, and an avoidance inclined surface which runs slantingly downwards is corporately formed by using the height difference. Refer to FIG. 5, 12 represents a plate for assembling with the terminal device. During the assembly, the bottom of the product is not flush with the assembly plane, and a gap is left.

Figure 3:
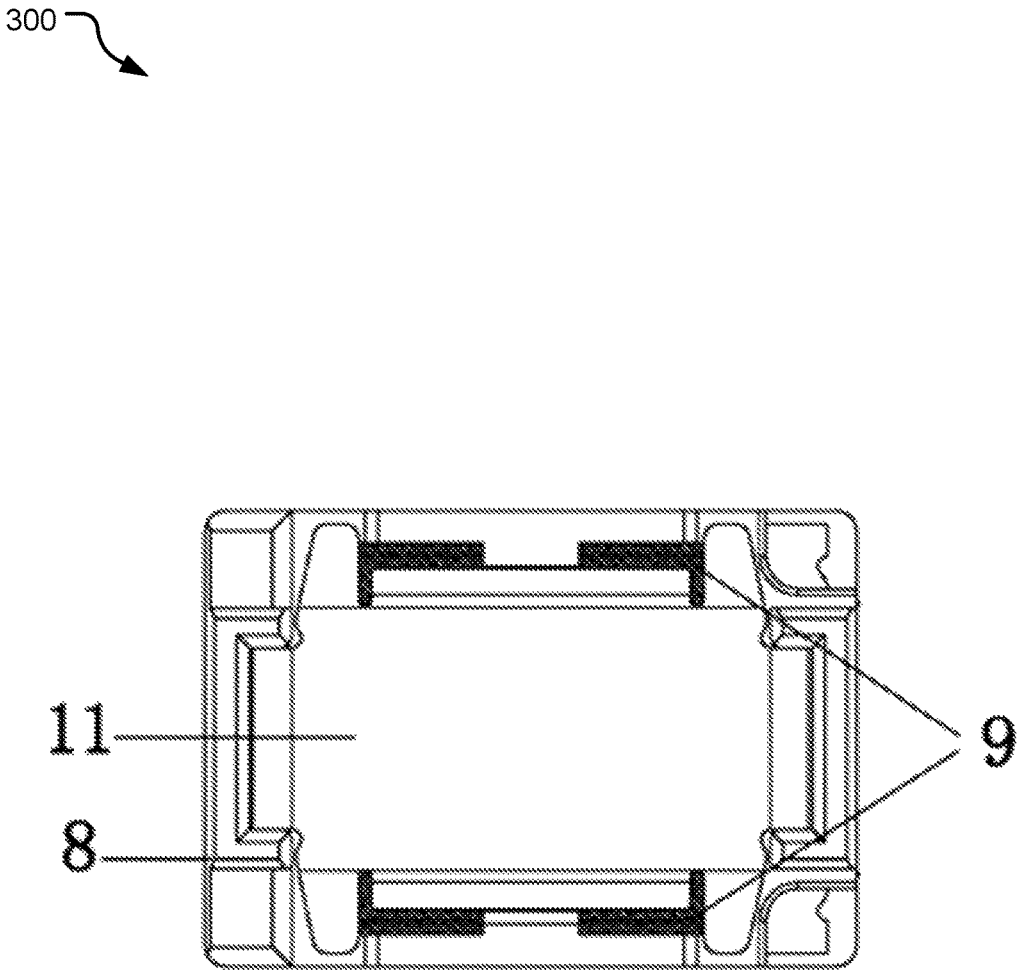
FIG. 3 is a schematic view of FIG. 2 with the damper structure removed.

As jointly shown in FIGS. 3, 4 and 5, the sound hole 9 is provided on the bottom wall of the housing 8, and the opening end of the sound hole 9 is located on the avoidance inclined surface. Correspondingly, the bottom surface of the sound hole 9 is an inclined surface and is not flush with the assembly plane. The sound hole 9 is adhered with a damper 10, and the damper 10 has a rectangular structure, and is matched with and fixed to the avoidance inclined surface at the bottom of the product, and the damper 10 covers the surface of the sound hole 9 obliquely so as to ensure that the sound hole 9 may let out the air from the lateral side.

Figure 6:
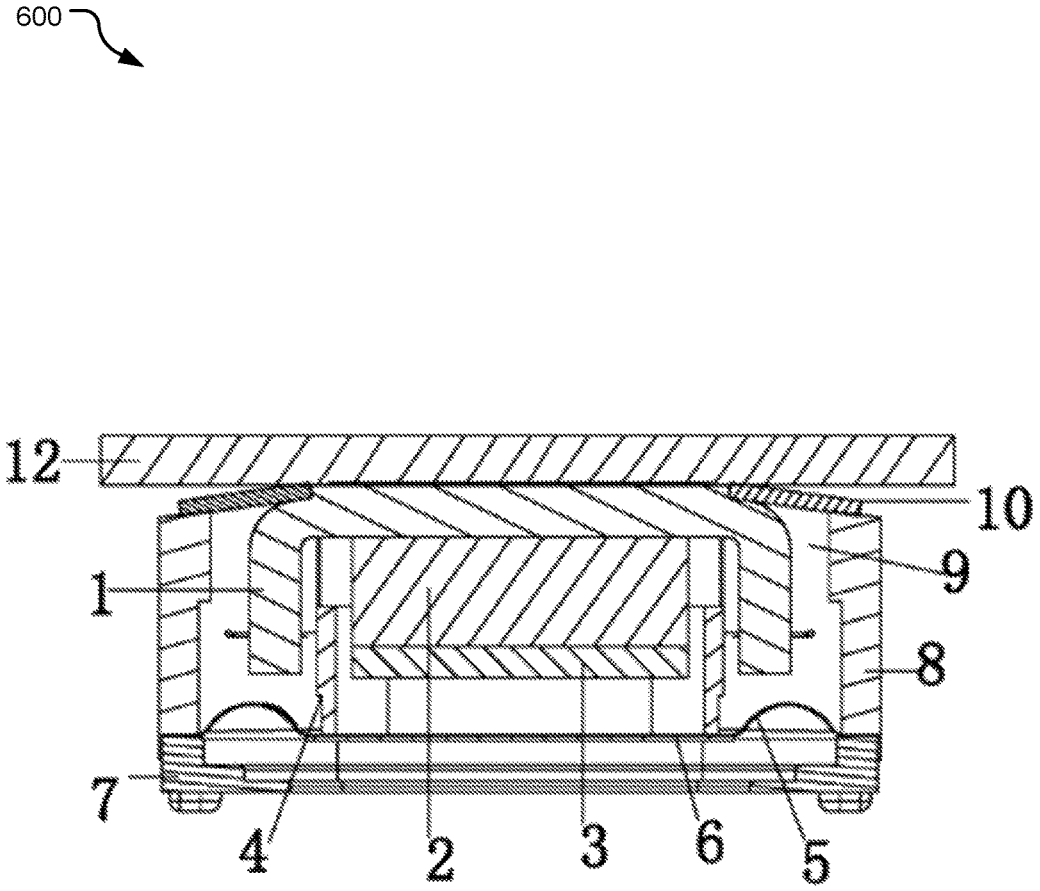
FIG. 6 is a schematic view for simulating machine assembly with the conventional micro loudspeaker.

As shown in FIGS. 5 and 6, the yoke 1 has a rectangular structure comprising a base in the horizontal direction and side portions protruding in the vertical direction. The yoke 1 is fixed in the mounting portion of the bottom wall of the housing 8, and the base thereof may be the assembly plane for performing machine assembly with the terminal device.

As shown in FIG. 4, a reinforcing member 6 is bonded to the intermediate position of the diaphragm 5. The inner edge of the diaphragm 5 surrounds the outer periphery of the reinforcing member 6, and generally, the reinforcing member 6 preferably has a rigid composite layer structure, mainly for enhancing performance of the product at high frequency.

The above mentioned are only embodiments of the present invention and are not for restricting the present invention, thus the equivalent modification or variation made by those skilled in the art according to the present invention should be incorporated into the scope of protection recorded in the claims.

What is claimed is:

1. A micro loudspeaker comprising a magnetic circuit system, a vibration system and a support system, wherein the magnetic circuit system comprises a yoke, and a magnet and a washer accommodated in the yoke; the vibration system comprises a diaphragm and a voice coil bonded and fixed to the diaphragm; and the support system comprises a front cover and a housing matched with and combined with the front cover, and wherein the housing comprises a bottom wall and a side wall, the bottom wall of the housing is provided with a mounting portion for accommodating the magnetic circuit system and is provided with an assembly plane for assembling with a terminal; a height difference is provided between a position of the bottom wall of the housing corresponding to the assembly plane and a position of the side wall of the housing corresponding to the assembly plane, so as to cooperatively form an avoidance inclined surface; and a sound hole is provided on the bottom wall of the housing, and an opening end of the sound hole is located on the avoidance inclined surface, the sound hole is covered with a damper, the damper has a rectangular structure and is matched with and fixed to the avoidance inclined surface of the housing, and the damper is adhered to a surface of the sound hole obliquely.

2. The micro loudspeaker according to claim 1, wherein the side wall of the housing has a rectangular structure formed by four upright sides, and a position of the side wall of the housing corresponding to a bottom surface of the micro loudspeaker is lower than a height of a position of the bottom wall of the housing corresponding to the bottom surface of the micro loudspeaker, so as to form the avoidance inclined surface and form the sound hole of which a bottom surface is an inclined surface correspondingly.

3. The micro loudspeaker according to claim 1, wherein the yoke has a rectangular structure, the yoke comprises a base in a horizontal direction and a side portion protruding in a vertical direction, and the yoke is fixed to the mounting portion of the bottom wall of the housing, and the base of the yoke is the assembly plane for assembling with the terminal.

4. The micro loudspeaker according to claim 1, wherein a reinforcing member is bonded to an intermediate position of the diaphragm, and an inner edge of the diaphragm surrounds an outer periphery of the reinforcing member.

* * * * *